US008937547B2

(12) United States Patent
Mattern

(10) Patent No.: US 8,937,547 B2
(45) Date of Patent: Jan. 20, 2015

(54) SYSTEM AND METHOD FOR NOTIFYING RECENT VISITORS TO A LOCATION

(76) Inventor: Jeremy Keith Mattern, Houston, TX (US)

( * ) Notice: Subject to any disclaimer, the term of this patent is extended or adjusted under 35 U.S.C. 154(b) by 42 days.

(21) Appl. No.: 13/544,034

(22) Filed: Jul. 9, 2012

(65) Prior Publication Data

US 2014/0009286 A1 Jan. 9, 2014

(51) Int. Cl.
*G08B 21/00* (2006.01)

(52) U.S. Cl.
USPC ..... 340/540; 340/3.1; 705/5

(58) Field of Classification Search
USPC ..... 340/540, 3.1, 5.1, 5.2, 6.1, 7.2, 286.02; 455/404.1, 404.2; 379/37, 39; 705/5
See application file for complete search history.

(56) References Cited

U.S. PATENT DOCUMENTS

| | | | | |
|---|---|---|---|---|
| 7,221,928 | B2 * | 5/2007 | Laird et al. | 455/404.1 |
| 8,384,549 | B2 * | 2/2013 | Lemmon | 340/573.1 |
| 2009/0138353 | A1 * | 5/2009 | Mendelson | 705/14 |
| 2012/0191488 | A1 * | 7/2012 | Alperin | 705/5 |
| 2013/0183924 | A1 * | 7/2013 | Saigh et al. | 455/404.2 |

* cited by examiner

*Primary Examiner* — Toan N Pham
(74) *Attorney, Agent, or Firm* — Spradley PLLC; Michael Spradley

(57) ABSTRACT

This disclosure relates to a system and method for mass notifying recent visitors to a location. In one embodiment, the mass notification method can comprise collecting at a registration point, contact information from one or more visitors to a facility. The method can further comprise storing the contact information and a check-in time in a profile in a mass notification server memory. The method can further comprise sending a notification message in response to an emergency and as a part of a mass notification, to the contact information within each of the profiles containing a check-in time that is earlier than a mass notification time by not more than a predetermined period of time.

13 Claims, 5 Drawing Sheets

SYSTEM AND METHOD FOR NOTIFYING RECENT VISITORS TO A LOCATION

BACKGROUND

This disclosure relates to a system and method for mass notifying recent visitors to a location.

Recently, terrorism has become a problem in many areas of the world, including on American soil. In such critical situations, communication is highly important. For this reason among others, mass notification systems have been developed and improved. However, in a facility, such as military installations, numerous individuals, uniformed or civilian individuals can enter and leave the vicinity regularly and repeatedly. As such, knowing whom to notify in a localized emergency can be difficult. Moreover, current mass notification systems are not designed for facilities comprising different visitors each day. For a military installation, particular notifications and instructions can be given to specific personnel on the base regularly, as they are known. However, visitors having minimal or irregular contact with the military installation may be difficult to contact during an emergency. Consequently, people who are not a part of the organization but none-the-less are in an area impacted by emergency may not be properly notified.

As such it would be useful to have an improved system and method for a mass notification for recent visitors to a location.

SUMMARY

This disclosure relates to a system and method for mass notifying recent visitors to a location. In one embodiment, the mass notification method can comprise collecting at a registration point, contact information from one or more visitors to a facility. The method can further comprise storing the contact information and a check-in time in a profile in a mass notification server memory. The method can further comprise sending a notification message in response to an emergency and as a part of a mass notification, to the contact information within each of the profiles containing a check-in time that is earlier than a mass notification time by not more than a predetermined period of time.

In another embodiment, a method can comprise collecting at a registration point, contact information from one or more visitors to a location. The embodiment can further comprise storing the contact information and a time period in profiles in a mass notification server memory, each of the profiles associated with one of the visitors. The method can further comprise sending a notification message in response to an emergency and as a part of a mass notification, to the contact information within each of said profiles comprising a time period that encompasses a mass notification time.

In another embodiment, a system can comprise a computer readable storage medium having a computer readable program code embodied therein. The computer readable program code can be adapted to be executed to implement the abovementioned methods.

DETAILED DESCRIPTION

Described herein is a system and method of mass notifying recent visitors to a location. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
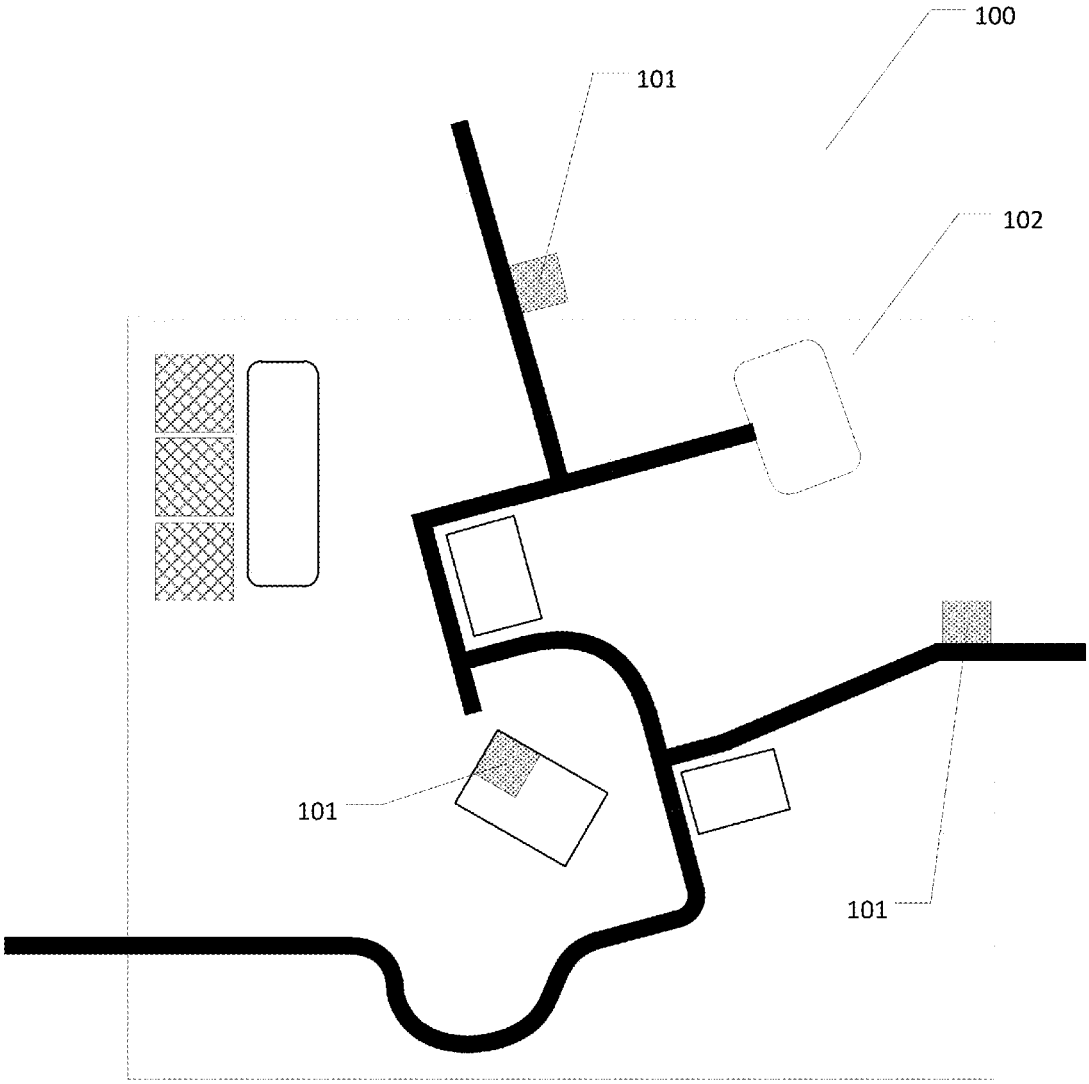
FIG. 1A illustrates an aerial view of a facility.

FIG. 1A illustrates an aerial view of a facility 100 comprising one or more registration points 101 strategically placed inside and outside a secured area 102. Facility 100 can refer to any public or private installations having a plurality of visitors daily. Secured area 102 can be the area within the border of facility 100. Registration points 101 can be locations 100 where a visitor can register with facility management. For purposes of this disclosure, the term "visitor" can comprise any person seeking registration at registration point 101.

Figure 1B:
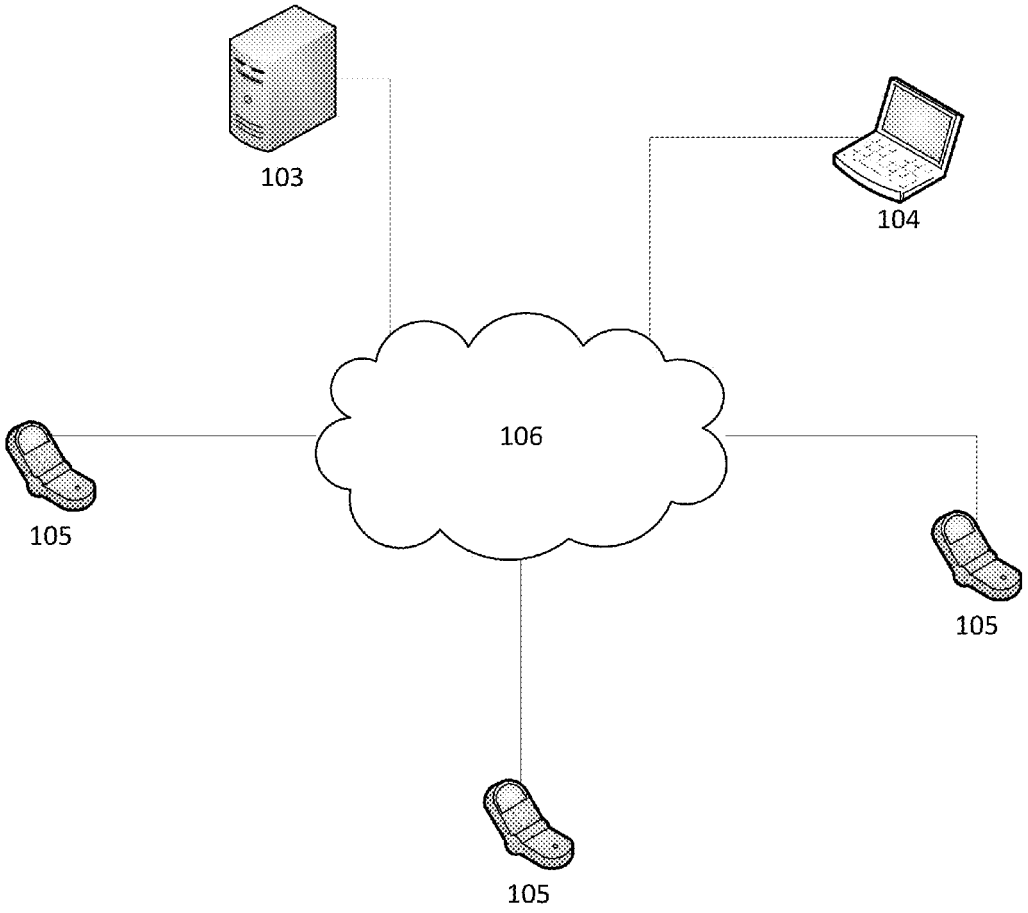
FIG. 1B illustrates a mass notification system.

FIG. 1B illustrates a mass notification system comprising a mass notification system server 103, a registration computer 104, and one or more communication devices 105 via a network 106. Mass notification system server 103 can comprise equipment in a facility 100, which is capable of carrying out arithmetic and logic operations. Mass notification system server 103 can provide a centralized set of instructions to mass notify information in an organization. Mass notification system server 103 can be capable of receiving instructions and carrying out different messages to provide information to various devices connected in network 106.

Registration computer 104 can be any equipment capable of carrying out arithmetic and logic operations. Registration computer 104 can store and send out data information through network 106. Registration computer 104 can include, but is not limited to, a laptop and/or a mobile device. Registration computer 104 can be placed on every registration point 101, and can be accessible to authorized personnel, and/or visitor.

Communication device 105 can be electronic handheld equipment used for communicating. Communication device 105 can include, but is not limited to, a mobile phone, a laptop, a landline telephone, a personal digital assistant (PDA), and/or a tablet. Network 106 can be a wide area network (WAN), or a combination of local area network (LAN), a landline telephone network, a cellular network, a data network, or any combination of the above. A LAN can be a network within a single organization while WAN can be the Internet.

Figure 2:
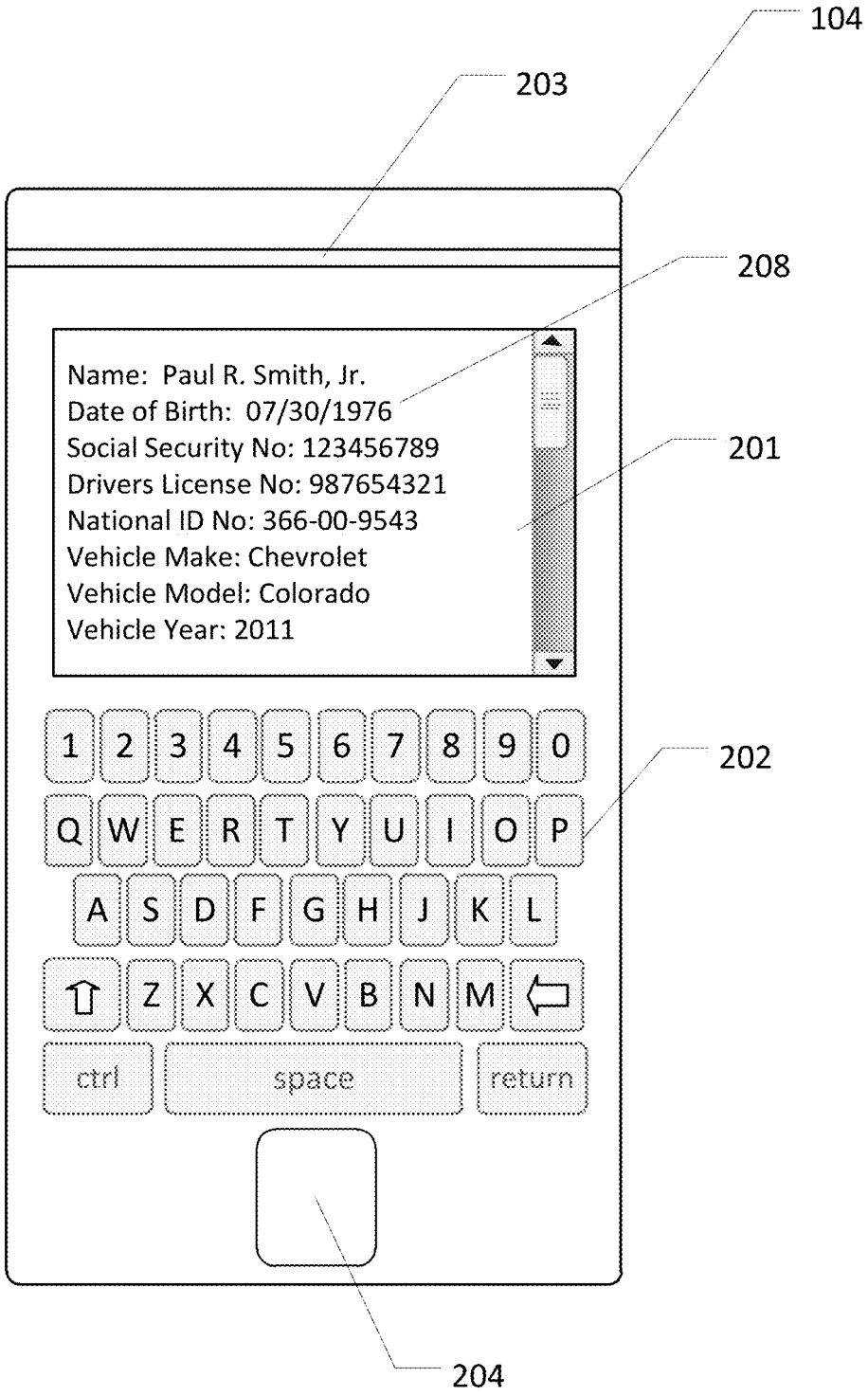
FIG. 2 illustrates an embodiment of registration computer.

FIG. 2 illustrates an embodiment of registration computer 104 as a mobile device. Mobile device can include, but is not limited to, a screen 201, a keypad 202, a card reader 203, and/or a fingerprint scanner 204. Other input devices can include track balls, joy sticks, or scroll wheels. Screen 201 can be a mere display output or a touch screen, allowing for capturing of identity information 208. Identity information 208 can include a visitor's name, mobile phone number, military rank, serial number, grade, military organization, military installation, address, and/or date of birth. Keypad 202 can comprise a plurality of physical buttons on a mobile device. However, in an embodiment where screen 201 is a touch screen, keypad 202 can be represented virtually on screen 201. Card reader 203 can read information from an identification card. An identification card can encode information in various ways. Information can be printed on the information card. Also, information can be placed on the card in a machine-readable form. Such forms can include magnetic strip, barcode or even radio frequency identification (RFID) chip. An identification card can include, but is not limited to, a civilian or military identification card, a passport, a school identification badge or a credit card. In one embodiment, card reader 203 can read a magnetic strip on an identification card. In another embodiment, card reader 203 can read information encoded in a barcode on an identification card. In another embodiment, card reader 203 comprises a (RFID) chip receiver to read an RFID chip in an identification card. In one embodiment, mobile device can read information encoded in a digital fingerprint scanned from a fingerprint scanner 204. In another embodiment, card reader 203 can read an integrated circuit card such as a Smart Card.

Figure 3A:
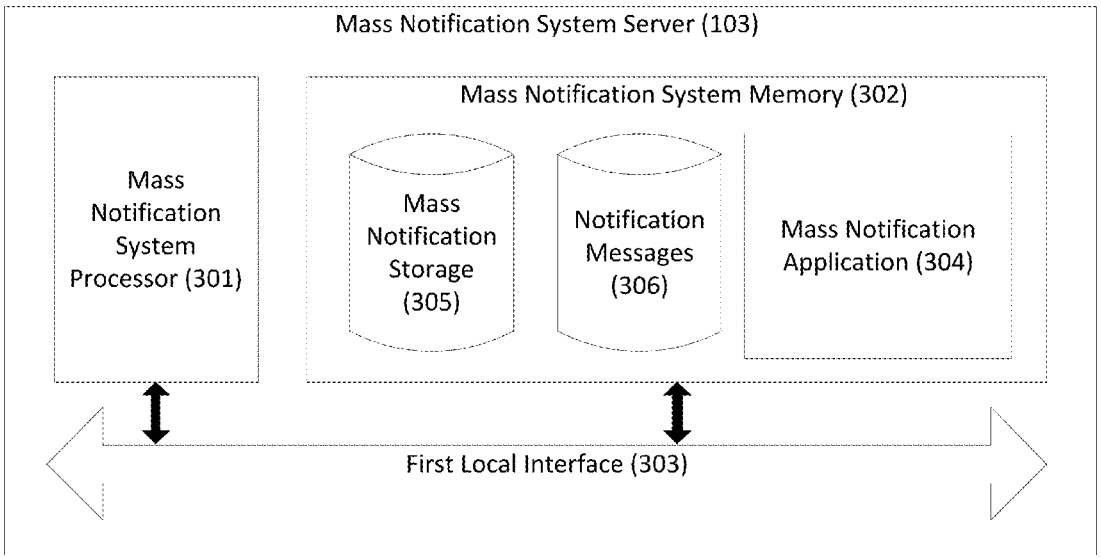
FIG. 3A illustrates a schematic diagram of a mass notification system.

FIG. 3A illustrates a schematic block diagram of a mass notification system server 103 in one embodiment. Mass notification system server 103 can comprise a mass notification system processor 301, a mass notification memory 302, and a first local interface 303. First local interface 303 can be a program that controls a display for the user, which can allow user to view and/or interact with mass notification system server 103. Mass notification system processor 301 can be a processing unit that performs a set of instructions stored within mass notification system memory 302. Mass notification system memory 302 can include a mass notification application 304, and a mass notification storage 305. Mass notification application 304 can be a program providing logic for mass notification system server 104. Further, mass notification application 304 can perform functions such as adding, updating, deleting, transferring, and retrieving information from mass notification storage 305. Profile 400 can be a collection of input data or identity information 208 transmitted through network 106, which can be stored within mass notification memory 302.

Mass notification system server 103 includes at least one processor circuit, such as, mass notification system processor 301 or mass notification memory 302, either of which is coupled to first local interface 303. To this end, the mass notification system server 103 can comprise, in one embodiment, at least one server, computer, or like device. First local interface 303 can comprise, for example, a data bus with an accompanying address/control bus or other bus structure as can be appreciated.

Data and several components executable by mass notification system processor 301, such as mass notification application 304 and potentially other applications, are stored in a mass notification memory 302. Also, mass notification storage 305 and other data can be stored in a mass notification memory 302. In addition, an operating system can be stored in a mass notification memory 302 and executable by mass notification system processor 301.

Figure 3B:
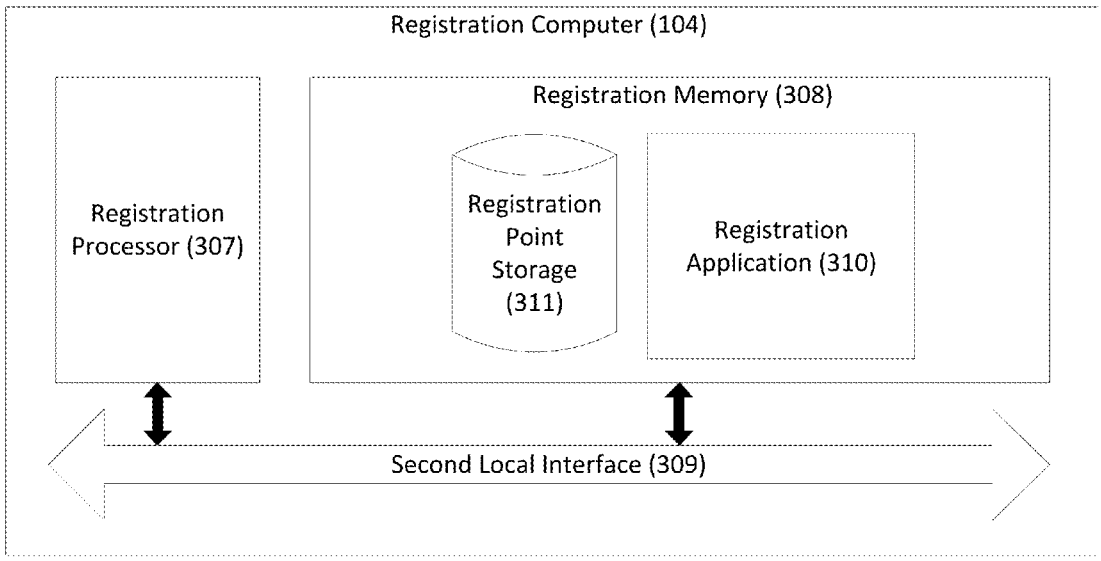
FIG. 3B illustrates a schematic diagram of a registration computer.

FIG. 3B illustrates a schematic block diagram of registration computer 104, according to an embodiment of the present disclosure. Registration computer 104 can comprise a registration processor 307, a registration memory 308, and a second local interface 309. Second local interface 309 can be a program that controls a display for the user, which can allow user to view and/or interact with check computer 104. Registration processor 307 can be a processing unit that performs a set of instructions stored within registration memory 308. Registration memory 308 can include a registration application 310 a registration point storage 311. Registration application 310 can be a program providing logic for registration computer 104. Furthermore, registration application 310 can perform functions such as adding, updating, deleting, transferring, and retrieving information from registration point storage 311.

Registration computer 104 includes at least one processor circuit, for example, having registration processor 307 and registration memory 308, both of which are coupled to second local interface 309. As such, the registration computer 104 can comprise, for example, at least one server, computer or similar device. Second local interface 309 can comprise, for example, a data bus with an accompanying address/control bus or other bus structure.

Both data and several components that are executable by registration processor 307 are stored in registration memory 308. In particular, stored in the registration memory 308 and executable by registration processor 307 are registration application 310, and potentially other applications. Also stored in registration memory 308 can be registration point storage 311 and other data. In addition, an operating system can be stored in registration memory 308 and executable by registration processor 307.

Other applications stored in mass notification memory 302 and registration memory 308 are executable by mass notification system processor 301 and registration processor 307. Where any component discussed herein is implemented in the form of software, any one of a number of programming languages can be employed such as, for example, C, C++, C#, Objective C, Java, Java Script, Perl, PHP, Visual Basic, Python, Ruby, Delphi, Flash, or other programming languages.

A number of software components can be stored in mass notification memory 302 and registration memory 308 and can additionally be executable by mass notification system processor 301 and registration processor 307. For the purposes of this disclosure, the term "executable" means a program file that is in a form that can ultimately be run by mass notification system processor 301 and registration processor 307. Executable programs can comprise at least one or more of the following: a compiled program that can be translated into machine code in a format that can be loaded into a random access portion of mass notification memory 302 and registration memory 308 run by mass notification system processor 301 and registration processor 307; source code executed by mass notification system processor 301 and registration processor 307 that can be expressed in proper format such as an object code capable of being loaded into a random access portion of mass notification memory 302 and registration memory 308; or source code that can be interpreted by another executable program to generate instructions in a random access portion of mass notification memory 302 and registration memory 308 to be executed by mass notification system processor 301 and registration processor 307. An executable program can be stored in any portion or component of mass notification memory 302 and registration memory 308 including, for example, random access memory (RAM), read-only memory (ROM), hard drive, solid-state drive, USB flash drive, memory card, optical disc, such as compact disc (CD), or digital versatile disc (DVD), floppy disk, magnetic tape, or other memory components.

Figure 4A:
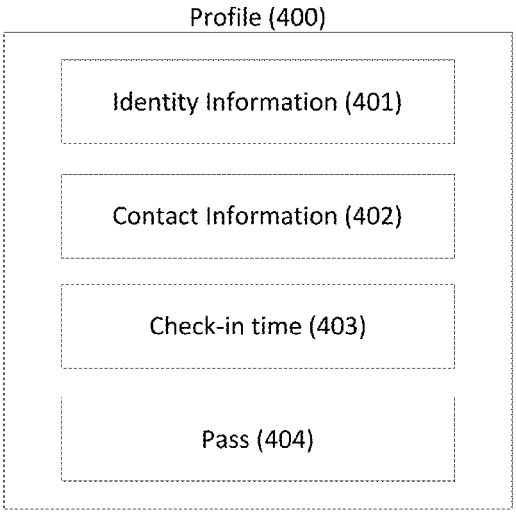
FIG. 4A illustrates an embodiment of data information found in a profile.

FIG. 4A illustrates a profile 400 stored in mass notification storage 305. Profile 400 can include data, which includes but is not limited to, identity information 401, contact information 402, a check-in time 403, and/or a pass 404. Contact information 402 can be a means of transmitting information to a specific individual. Pass 404 can be authorization to enter secured area 102 or facility 100. In one embodiment, pass 404 can indicate the amount of time an individual can stay within the location. In one embodiment, pass 404 can comprise a period of validity, represented by an expiration date or time period the pass is good for measured by from a time of issuance.

Figure 4B:
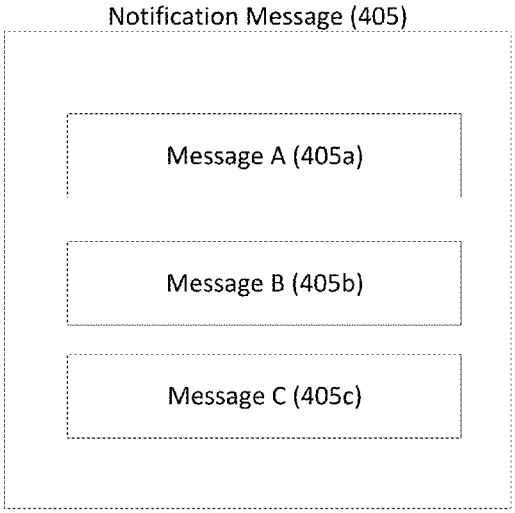
FIG. 4B illustrates a notification message.

FIG. 4B illustrates notification messages 405 comprising a message A 405*a*, a message B 405*b*, and a message C 405*c*. Messages 405*a*, 405*b*, and 405*c* can be a different set of messages, which can be intended to be sent to different sets of individuals. Furthermore, message 405*a* can be in a different format and/or construct compared to message 405*b*, and 405*c*. In one embodiment, notification messages 405 can be a preset collection of messages. In another embodiment, notification messages 405 can be customized, and/or set by authorized personnel before or after an emergency. As such, authorized personnel can access mass notification system server 103 and use mass notification application 304 to add, modify, and/or remove a specific notification message 405.

Figure 5:
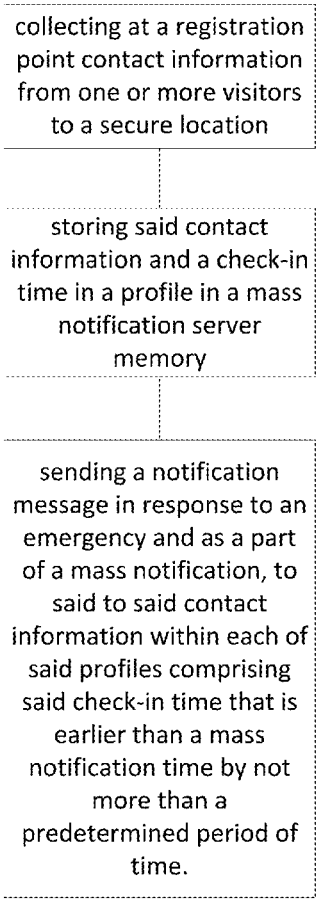
FIG. 5 illustrates an exemplary method for mass notifying recent visitors.

FIG. 5 illustrates an exemplary flow of diagrams for mass notifying recent visitors. In a registration scenario, visitors can present identification to personnel on duty, or directly to computer 104. The personnel or visitor can check in visitor by either keying-in visitor's information, swiping identity card presented, and/or scanning the visitor's fingerprint, or collecting said data to query identity information 401 of the visitor. Once determined, check-in time 403 can be added to profile 400. Contact information 402 can comprise a phone number and/or an email address in one embodiment. In one embodiment, identity information 401 can comprise contact information 402. If a visitor is not registered in mass notification server 103, then a new profile can be created at registration point 101, in one embodiment. Contact information 402 collected using registration computer 104 can be stored in the new profile 400, along with check-in time 403 if visitor is checking in to facility 100 or secured area 102

Emergencies can include, for example, terroristic attacks, warnings of imminent terroristic attacks, or gunfire detection on or near a secured area 102. In any emergency, mass notification system server 103 can choose people to contact in a variety of methods. In one embodiment, mass notification application 304 can send one or more of notification messages 405 to each visitor who has visited facility 100 within a predetermined period of time from check-in time 403. For example, if the predetermined period of time were 24 hours, then any person checking into facility 100 or secured area 102 within 24 hours of initiating mass notification would receive notification message 304. Further, notification message 405 can vary according to other information stored in profile 400. For example, notification message 405 can be different depending on whether visitor is military or non-military. In such embodiment, mass notification application 304 can query profiles 400 to determine which members to contact. The predetermined period of time can be determined before an emergency, or can be chosen at the time mass notification system is prompted to begin contacting visitors.

In another embodiment, mass notification application 304 can send notification message 405 to each visitor holding a valid pass 404 still within its period of validity. Such period of validity can be noted within profile 400, along with check-in time 403—in this embodiment, when pass 404 was first valid. As an example of this embodiment, if a visitor arrives at facility 100, is issued a seven-day pass 404 that is immediately valid, and five days later an emergency occurs, then such visitor will be notified by mass notification system. If however, an emergency occurs eight days later, then such visitor will not be notified in such embodiment.

Mass notification memory 302 and registration memory 308 is defined herein as including both volatile and nonvolatile memory and data storage components. Volatile components are defined as components that do not retain data values upon loss of power. Nonvolatile components are those that retain data upon a loss of power. Thus, mass notification memory 302 and registration memory 308 can comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM can comprise, for example, static random access memory (SRAM), dynamic random access memory (DRAM), or magnetic random access memory (MRAM) and other such devices. The ROM can comprise, for example, a programmable read-only memory (PROM), an erasable programmable read-only memory (EPROM), an electrically erasable programmable read-only memory (EEPROM), or other like memory device.

Also, mass notification system processor 301 and registration processor 307 can represent multiple mass notification system processors 301 and registration processors 307, while mass notification system memory 302 and registration memory 308 can represent multiple mass notification system memory 302 and registration memory 308 that operate in parallel processing circuits, respectively. In such a case, first local interface 303 and second local interface 309 can be an appropriate network, including network 106 that facilitates communication between any two of the multiple mass notification system processor 301 and registration processor 307, between any mass notification system processor 301 and registration processor 307 and any of the mass notification system memory 302 and registration memory 308, or between any two of the mass notification system memory 302 and registration memory 308, etc. First local interface 303 and second local interface 309 can comprise additional systems designed to coordinate this communication, including, for example, performing load balancing. Mass notification system processor 301 and registration processor 307 can be of electrical or of some other available construction.

Although mass notification application 304 and registration application 310, and other various systems described herein can be embodied in software or code executed by general purpose hardware as discussed above, as an alternative the same can also be embodied in dedicated hardware or a combination of software/general purpose hardware and dedicated hardware. If embodied in dedicated hardware, each can be implemented as a circuit or state machine that employs any one of or a combination of a number of technologies. These technologies can include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowcharts of FIG. 5 show the functionality and operation of an implementation of portions of mass notification application 304 and registration application 310. If embodied in software, each block can represent a module, segment, or portion of code that comprises program instructions to implement the specified logical function(s). The program instructions can be embodied in the form of source code that comprises human-readable statements written in a programming language or machine code that comprises numerical instructions recognizable by a suitable execution system such as mass notification system processor 301 and registration processor 307 in a computer system or other system. The machine code can be converted from the source code, etc. If embodied in hardware, each block can represent a circuit or a number of interconnected circuits to implement the specified logical function(s).

Although the flowcharts of FIG. 5 show a specific order of execution, the order of execution can differ. For example, the order of execution of two or more blocks can be scrambled relative to the order shown. Also, two or more blocks shown in succession in FIG. 5 can be executed concurrently or with partial concurrence. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including mass notification application 304 and registration application 310, that comprises software or code can be embodied in any computer-readable storage medium for use by or in connection with an instruction execution system such as, for example, mass notification system processor 301 and registration processor 307 in a computer system or other system. In this sense, the logic can comprise, for example, statements including instructions and declarations that can be fetched from the computer-readable storage medium and executed by the instruction execution system.

For the purposes of this disclosure, a "computer-readable storage medium" can be any medium that can contain, store, or maintain the logic or application described herein for use by or in connection with the instruction execution system. The computer-readable storage medium can comprise any one of many physical media such as, for example, electronic, magnetic, optical, electromagnetic, infrared, or semiconductor media. More specific examples of a suitable computer-readable storage medium would include, but are not limited to, magnetic tapes, magnetic floppy diskettes, magnetic hard drives, mass notification memory 302 and registration memory 308 cards, solid-state drives, USB flash drives, or optical discs. Also, the computer-readable storage medium can be a random access memory (RAM) including, for example, static random access memory (SRAM) and dynamic random access memory (DRAM), or magnetic random access memory (MRAM). In addition, the computer-readable storage medium can be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications can be made to the above-described embodiment(s) without departing substantially from the spirit and principles of the disclosure. All such modifications and variations are intended to be included herein within the scope of this disclosure and protected by the following claims.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A mass notification method comprising collecting at a registration point, contact information from one or more visitors to a facility;

storing said contact information and a check-in time in a profile in a mass notification server memory;

sending a notification message in response to an emergency and as a part of a mass notification, to said contact information within each of said profiles comprising said check-in time that is earlier than the notification message time by not more than a predetermined period of time.

2. The method of claim 1 wherein said contact information comprises a phone number.

3. The method of claim 1 wherein said contact information comprises an email.

4. The method of claim 1 wherein said predetermined period of time is 48 hours or less.

5. The method of claim 1 wherein said emergency is a terroristic attack.

6. The method of claim 1 wherein said emergency is a warning of a threatened terroristic attack.

7. The method of claim 1 wherein said emergency is detection of gunfire.

8. The method of claim 1 wherein said facility is a military installation.

9. The method of claim 1 wherein said one or more visitors comprises military personnel and civilians.

10. A mass notification method comprising collecting at a registration point, contact information from one or more visitors to a location;

issuing each of said one or more visitors a pass;

storing said contact information and a time period in profiles in a mass notification server memory, each of said profiles associated with one of said visitors;

sending a notification message in response to an emergency and as a part of a mass notification, to said contact information within each of said profiles comprising said time period that encompasses a mass notification time, further wherein said time period is a period of validity associated with said pass.

11. The method of claim 10 wherein said contact information comprises a phone number.

12. The method of claim 10 wherein said contact information comprises an email.

13. A computer readable storage medium having a computer readable program code embodied therein, wherein the computer readable program code is adapted to be executed to implement the method of claim 1.

* * * * *